United States Patent [19]

Ogou et al.

[11] Patent Number: 4,889,312

[45] Date of Patent: Dec. 26, 1989

[54] WATERSTOP FOR CONCRETE FORM SEPARATOR

[75] Inventors: Sunoo Ogou, Ogoori; Shigemichi Ishii, Tosu; Sadaaki Tagomori, Ogoori; Takuo Fukushima, Yachiyo; Yasumasa Hayashida, Ageo, all of Japan

[73] Assignee: Asahi Denka Kogyo Kabushiki Kaisha, Tokyo, Japan

[21] Appl. No.: 233,661

[22] PCT Filed: Nov. 11, 1987

[86] PCT No.: PCT/JP87/00869

§ 371 Date: Jul. 5, 1988

§ 102(e) Date: Jul. 5, 1988

[87] PCT Pub. No.: WO88/03591

PCT Pub. Date: May 19, 1988

[30] Foreign Application Priority Data

Nov. 11, 1987 [JP] Japan ..... 62-173717

[51] Int. Cl.[4] ..... E04G 17/08

[52] U.S. Cl. ..... 249/216; 52/232; 249/42

[58] Field of Search ..... 249/41, 42, 43, 45, 249/97, 134, 214, 216, 217; 52/98, 223 L, 232

[56] References Cited

U.S. PATENT DOCUMENTS

| | | | |
|---|---|---|---|
| 4,186,906 | 2/1980 | Koga | 249/42 |
| 4,234,156 | 11/1980 | Wepf | 249/41 |

FOREIGN PATENT DOCUMENTS

| | | | |
|---|---|---|---|
| 1026533 | 2/1978 | Canada | 249/217 |
| 2005210 | 9/1971 | Fed. Rep. of Germany | 249/42 |
| 43-27286 | 11/1968 | Japan . | |
| 51-20040 | 5/1976 | Japan . | |
| 58-14907 | 3/1983 | Japan . | |

*Primary Examiner*—James C. Housel

*Attorney, Agent, or Firm*—Frishauf, Holtz, Goodman & Woodward

[57] ABSTRACT

The present invention relates to a device for prevention of rainwater or like from penetrating into a concrete structure around each separator left embedded therein, the device comprising a hollow cylinder of synthetic resin, the latter including a female threaded cylinder made of metal or other material embedded in the interior at one end thereof and water-swollen damming-up outer rings fixed on the outer periphery so as to serve together as terminals, a threaded cylindrical portion formed at one end of each of the terminals being engaged with a male threaded portion formed around the corresponding end of the separator, and the cylinder of synthetic resin further including a plug provided with a water-swollen damming-up inner ring fixed into the interior at the other end thereof.

6 Claims, 2 Drawing Sheets

WATERSTOP FOR CONCRETE FORM SEPARATOR

BACKGROUND OF THE INVENTION

1. Field of the Invention:

The present invention relates to a device for preventing, in a concrete structure such as a concrete wall, rainwater or like from penetrating through a concrete wall surface into the concrete structure around each separator which has been left embedded therein.

2. Description of the Prior Art:

In constructing the above-mentioned concrete structure such as the concrete wall, the separator is usually used to hold each pair of molds opposed to each other at a predetermined distance and such separator is left embedded in the concrete structure after completion of this structure. More particularly, each separator is provided on its opposed ends with separator terminals, respectively, and these separator terminals are removed when the molds are disassembled upon completion of the construction. This results in formation of a recess in the concrete wall in a region which has been occupied by each of the separator terminals. Such recess must be filled up in a suitable manner for water-sealing effect.

One well-known device for prevention of rainwater or like from penetrating in the region of each separator into the concrete structure has already been described in Utility Model Publication No. 43-27286, published in Japan on Nov. 12, 1968.

However, in this device of well known art, plugs are secured with adhesive into the recesses formed in the concrete wall surface after the separator terminals have been removed from the respective separators. Such feature leads to various problems as follow:

(1) It is difficult for adhesive to spread uniformly between the inner surface of the recess and the associated plug and often a gap is formed therebetween.

(2) A gap is progressively formed between the inner surface of the recess and adhesive as the years go by, due to factors such as contraction of concrete and adhesive occurring during hardening thereof.

(3) A gap is formed also between the concrete wall and the separator.

(4) A covering depth between the concrete wall surface and the separator is relatively poor.

In consequence, said gaps serve as water passages by which rainwater or like penetrates from the wall surface through the gap between the recess in the concrete wall and the plug into the other gap between the concrete wall and the separator, causing the separator to be rusted.

These problems result in:

(a) Durability of the structure deteriorates.

(b) Rust containing water exudes over the wall surface and injures the beauty of the wall surface.

SUMMARY OF THE INVENTION

A principal object of the present invention is, therefore, to provide a device adapted to effectively prevent rainwater or like from penetrating through the wall surface into the concrete wall around each separator left therein and thereby to overcome the problems as set forth above.

The present invention provides a device for prevention of rainwater or like from penetrating into a concrete structure around each separator left embedded therein, said device comprising a hollow cylinder of synthetic resin, the latter including a female threaded cylinder made of metal or other material embedded in the interior at one end thereof and water-swollen damming-up outer rings fixed on the outer periphery so as to serve together as terminals, a threaded cylindrical portion formed at one end of each of said terminals being engaged with a male threaded portion formed around the corresponding end of the separator, and said cylinder of synthetic resin further including a plug provided with a water-swollen damming-up inner ring fixed into the interior at the other end thereof.

When each of the separator terminals is incorporated with the device according to the present invention, any quantity of water having penetrated into the gap defined between the concrete wall A and the cylinder 1 of the terminal 4 is dammed up by the water-swollen damming-up outer ring 3 against further penetration further inwards.

On the other hand, any quantity of water having penetrated into the gap defined between the cylinder 1 of the terminal 4 and the plug 8 is dammed up by the water-swollen damming-up inner ring 7 against penetration further inwards.

Figure 1:
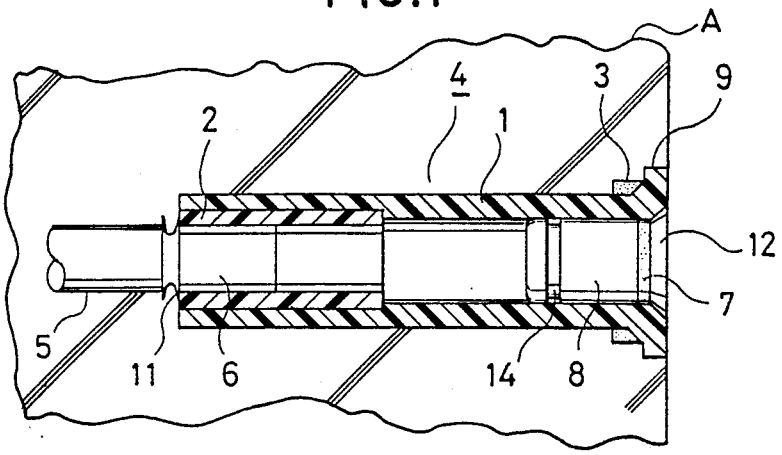
FIG. 1 is a longitudinal sectional view illustrating an important part of a concrete structure incorporated with a device for prevention of rainwater or like from penetrating thereinto constructed according to an embodiment of the present invention.
Figure 2:
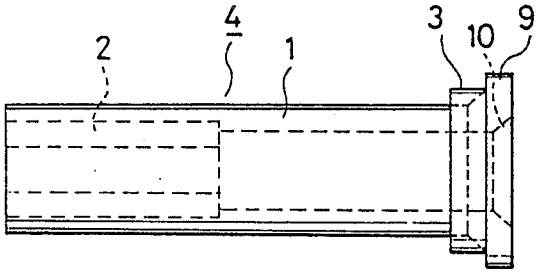
FIG. 2 is a frontal view illustrating one of terminals forming part of said device.
Figure 3:
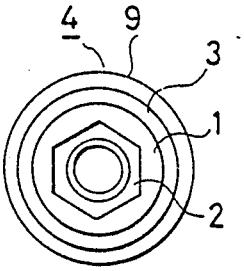
FIG. 3 is a side view of said terminal.
Figure 4:
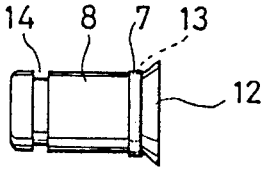
FIG. 4 is a frontal view illustrating a plug provided with a water-swollen damming-up inner ring.

DETAILED DESCRIPTION OF THE INVENTION:

The present invention will be described with respect to an embodiment as illustrated by the accompanying drawings. Referring to the drawings, a reference A designates a concrete wall and a reference 4 designates a terminal adapted to be threaded onto a corresponding end of each separator 5 which is, in turn, adapted to be embedded in said concrete wall A. The terminal 4 comprises a hollow cylinder 1 made of synthetic resin, including a female threaded cylinder 2 received and embedded in the interior at one end thereof, a flange 9 provided therearound at the other end, an outwardly flared recess 10 formed in the inner wall thereof at said other end and a water-swollen damming-up outer ring 3 fixed around the outer periphery thereof adjacent said flange 9. A reference 5 designates a separator provided at opposite ends with respective male threads 6 having their base ends in the form of stoppers 11. A reference 8 designates a plug made of synthetic resin having a tapered head 12 at its base end, circumferential grooves 13, 14 formed therearound at its base end and front end, respectively, so that the circumferential groove 13 receives a water-swollen damming up inner ring 7 slightly projecting from the outer periphery of said plug 8 and the circumferential groove 14 is coated with suitable water-swollen sealing agent, if necessary. A reference 15 designates a water-swollen damming-up outer ring fixed around the separator 5 at its middle position.

Examples of the water-swelling waterstop material to be used for the water-swelling rings 3, 7 and 15 include acryl, vinyl and inorganic water-swelling resins. It is particularly preferable to use a flexible material containing water-swelling polyurethane which comprises a mixture of a water-swelling polyurethane resin, and for example, natural, synthetic or reclaimed rubber, therefor.

Such a flexible material as described above may be obtained by kneading one or more polyether polyols of the following general formula:

$$R[(OR)_n]_p$$

wherein R represents a polyhydric alcohol residue; (OR) represents a polyoxyalkylene chain comprising oxyalkylene groups each having an oxyethylene group and an alkylene group carrying three or four carbon atoms, provided that the content of the oxyethylene groups amounts to 20 to 100% of the total molecular weight;

n is a number corresponding to the degree of polymerization of the oxyalkylene groups and giving a hydroxyl group equivalent of 200 to 2500; and p is a number of 2 to 8, preferably 2 to 4; together with urethane polymer(s) having polyisocyanate groups, a crosslinking agent and the rubber as defined above followed by curing.

Examples of said polyhydric alcohol include dihydric alcohols such as ethylene glycol and propylene glycol; trihydric alcohols such as glycerol and trimethylolpropane; tetrahydric alcohols such as erythritol and pentaerythritol; pentahydric alcohols such as arabitol and xylitol; and hexahydric alcohols such as sorbitol and mannitol.

Said polyether polyols may be obtained by adding alkylene oxide(s) to these polyhydric alcohols in such a manner as to give the desired molecular weight. Either random or block addition may be employed therefor. When the content of the oxyethylene groups is less than 20%, the resulting material is unsatisfactory as a waterstop material. Any polyisocyanates may be employed. The content of the terminal isocyanate groups may be 1 to 12%, preferably 2 to 7%.

Example of said crosslinking agent include polyols and polyamines each carrying two to six active hydrogen atoms per molecule and has an average molecular weight per active hydrogen atom of 30 to 15000, for example, low-molecular weight polyols, addition polymers of low-molecular weight polyols and alkylene oxides and addition polymers of low-molecular weight polyamines and alkylene oxides, as well as mixtures thereof.

It is preferable that the flexible material as described above contains 20 to 800 parts of water-swelling polyurethane resin per 100 parts of the rubber.

Other examples of preferable flexible materials are those obtained by further adding hydraulic material(s) to a composition comprising said water-swelling polyurethane resin and rubber. Examples of available hydraulic materials include Portland cement, blast furnace cement, colloidal cement and gypsum. It is preferable to employ a curing accelerator for cement comprising calcium aluminate simultaneously therewith. A flexible material comprising such a hydraulic material has an advantage that it shows little shrinkage when dried. It is preferable that the hydraulic material is blended in an amount of 20 to 30 parts per 100 parts of the mixture of the water-swelling polyurethane and rubber.

The above flexible material may further contain appropriate water-absorbing material(s). Examples of the water-absorbing materials include those mainly comprising an $\alpha,\beta$-unsaturated compound, which carries one or more carboxyl groups or those capable of being derived thereto such as carboxyl, carboxylate, carboxylic imide, carboxylic amide or carboxylic anhydride groups per molecule, and optionally polymerized with other $\alpha,\beta$-unsaturated compound(s) and/or modified with isocyanate(s).

Examples of such a water-absorbing resin include conventional water-absorbing polymers such as starch-acrylic acid graft copolymer, a salt of styrene/maleic anhydride copolymer, crosslinked poly(sodium acrylate), vinyl ester/ethylenically unsaturated carboxylic acids, and saponified products or derivatives thereof.

The flexible material may be further vulcanized with the use of a crosslinking agent such as sulfur.

It is preferable that the composition of the flexible material may be controlled in such a manner as to give a water-swelling ratio of the resulting molded article of 10 to 350%, still preferably 40 to 250%.

Figure 5:
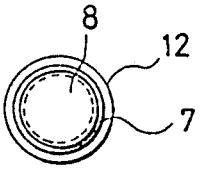
FIG. 5 is a side view of said plug.
Figure 6:
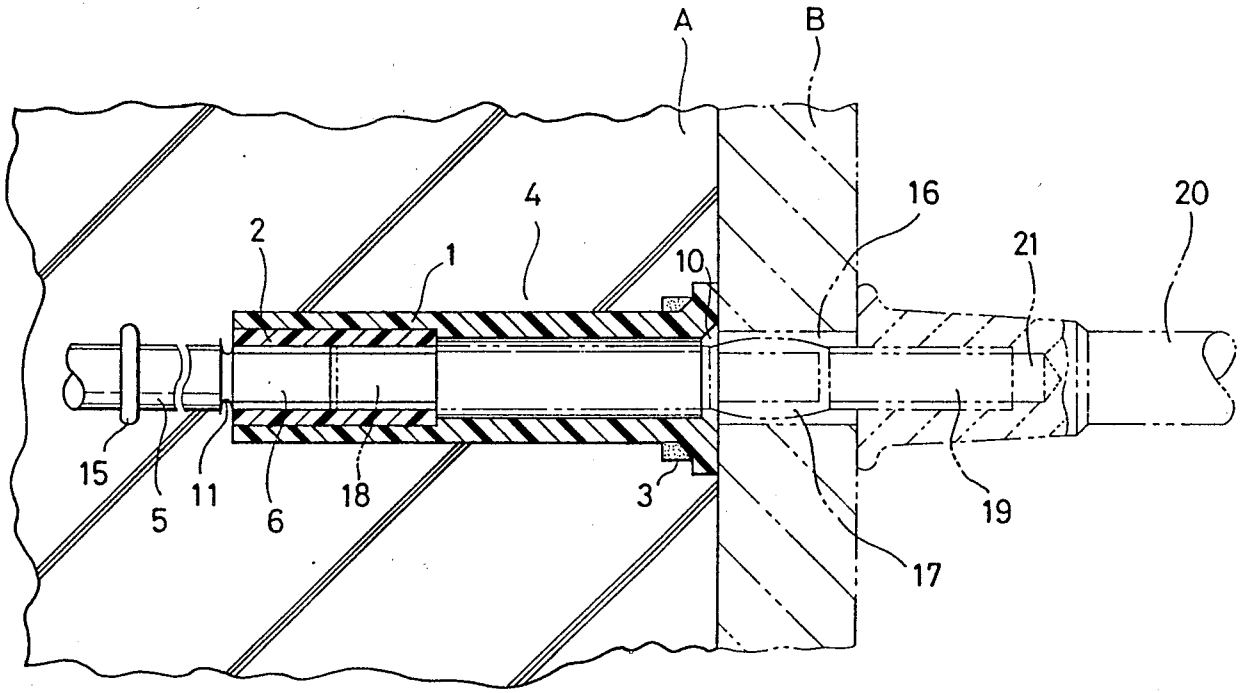
FIG. 6 is a longitudinal sectional view illustrating an important part of a concrete structure constructed with use of said terminals but before the plug is secured thereto.

FIG. 5 is a side view of said plug and FIG. 6 is a longitudinal sectional view illustrating an important part of a concrete structure constructed with use of said terminals but before the plug is secured thereto. Referring to FIG. 6, a reference B designates a concrete mold having a through-hole 16 at an appropriate location. A reference 17 designates a connecting bolt having male threads 18, 19 on opposite ends, respectively. A reference 20 designates a mold clamping lever having a threaded hole 21 formed in a base end thereof.

Now it will be considered how to construct a concrete wall using the device for prevention of rainwater or like from penetrating thereinto according to the present invention. As shown in FIG. 6, one end of the female threaded cylinder 2 of the terminal 4 carrying the water-swollen damming-up outer ring 3 fixed around the cylinder 1 is advanced in engagement with the male thread 6 of the separator 5 to the stopper 11 of said male thread 6 and the male thread 18 of the connecting bolt 17 is threaded into the other end of said female threaded cylinder 2.

Then, the connecting bolt 17 is inserted into the through-hole 16 of the mold B and the threaded hole 21 of the mold clamping lever 20 is threaded on the male thread 19 of said connecting bolt 17 so that the mold B is held between the terminal 4 and the mold clamping lever 20. Although FIG. 6 illustrates only the mold at one side, the arrangement is same at the opposite side and a pair of molds are held at a predetermined distance from each other. Thereafter, vertical and horizontal batters are combined on the outside of the mold B in the conventional manner, although not shown, these batters are clamped together by suitable means through the mold clamping levers 20 so as to fix the mold. Then, concrete may be placed into an internal space defined between the pair of the molds to construct the concrete wall A.

Upon hardening of concrete which forms the concrete wall A, the molds are disassembled and then the connecting bolts 17 are threaded out.

Then, as seen in FIG. 1, the plug 8 carrying the water-swollen damming-up inner ring 7 is forced into the hollow interior of the synthetic resin cylinder 1 from the other end and the head 12 of said plug 8 is engaged in the recess 10 of the cylinder 1 so as to fill said recess 10 with said head 12.

Said water-swollen damming-up outer ring 3 performs the similar function even when said outer ring 3 is fixed around the cylinder 1 at any other position. Additionally, as illustrated in FIG. 6, the water-swollen damming-up ring 15 may be fixed around the separator 5 at any position to further improve water-sealing effect.

The device for prevention of rainwater or like from penetrating into the concrete structure around each of the separators constructed in accordance with the present invention provides significant effects as follow:

(1) The separator terminals are of the embedded type, therefore, (a) Neither application of separating material nor operation of the terminal removal is required so that the operation efficiency is drastically improved and the work cost can be reduced.

(b) Concrete crack possibly associated with removal of the terminals can be avoided.

(c) Finish of the terminals is accomplished simply by mounting the plugs, enabling the finished appearance to be aesthetically improved.

(2) The female threaded cylinder made of metal or other material is embedded into the synthetic resin cylinder of the terminal at one end thereof and one end of said female threaded cylinder is engaged with the male thread on the separator. Accordingly, it is possible to obtain a relatively large covering depth from the wall surface to the components such as the separator and the metallic female threaded cylinder. This means that the metallic components such as the separator and the female threaded cylinder are prevented from being rusted due to rainwater or like would otherwise penetrate through the wall surface into the structure and thereby deterioration of the concrete structure is avoided. This is effective particularly for the structure at the seaside exposed to injury from salt.

(3) Rainwater or like penetrating through the wall surface into the gap defined between the concrete wall and the terminal is dammed up by the water-swollen damming-up outer ring fixed around the terminal against further penetration inwards and rainwater or like penetrating into the gap defined between said terminal and the plug thereof is dammed up by the water-swollen damming-up inner ring disposed therebetween against further penetration inwards.

With a consequence, it is effectively avoided that rainwater or like might penetrate through the wall surface, through the gap defined between the concrete wall and the terminal and through the gap defined between the terminal and the plug into the concrete wall around the separator. Therefore:

(a) The separator is prevented from being rusted, improving the durability of the concrete structure.

(b) There is no possibility that rust containing water exudes over the wall surface, injuring the aesthetic appearance of the wall surface.

(4) Rainwater or like penetrating into the gap defined between the concrete wall and the terminal and/or the gap defined between the terminal and the plug swells the water-swollen damming-up rings disposed within these gaps so that the damming-up rings thus swollen are no pressed against the concrete wall and the terminal and/or the terminal and the plug, respectively, perfectly filling up these gaps and thereby further reliably preventing rainwater or like from penetrating into the concrete wall around the separator terminal.

(5) Arrangement is simple, enabling it to be easily manufactured as a low cost and providing a stable fixation.

What is claimed is:

1. A waterstop for a concrete form separator, comprising:

(A) a terminal member including:

(1) a hollow cylinder of synthetic resin, having opposite ends, an interior, and an outer peripheral surface;

(2) a female threaded cylinder made of metal mounted in the interior at one end of said synthetic resin hollow cylinder; and (3) a water-swollen damming-up outer ring mounted at the other end of said synthetic resin hollow cylinder and around the outer peripheral surface of said synthetic resin hollow cylinder and having sufficient thickness for preventing rainwater from penetrating into a gap defined between said synthetic resin hollow cylinder and a concrete structure;

(B) a separator member having a male threaded portion engaging with said female threaded cylinder of said terminal; and (C) a plug mounted within the interior of said other end of said synthetic resin hollow cylinder, said plug having a water-swollen damming-up inner ring mounted therearound and having a sufficient thickness for preventing rainwater from penetrating through a gap defined between said synthetic resin hollow cylinder and said plug.

2. A waterstop for a concrete form separator according to claim 1, wherein said plug comprises:

a tapered head at a base end thereof, said tapered head comprising a tapered outer peripheral surface portion of said plug; and a circumferential groove in said plug adjacent said tapered head to receive said water-swollen damming-up inner ring therein.

3. A waterstop for a concrete form separator according to claim 2, wherein said inner ring comprises flexible material.

4. A waterstop for a concrete form separator according to claim 2, wherein said inner ring is fixed to said plug.

5. A waterstop for a concrete form separator according to claim 1, wherein said outer ring comprises flexible material.

6. A waterstop for a concrete form separator according to claim 1, wherein said outer ring is fixed to the outer peripheral surface of said synthetic resin hollow cylinder.

* * * * *